United States Patent [19]

Doom

[11] 4,072,296

[45] Feb. 7, 1978

[54] MOTIONLESS MIXER

[76] Inventor: Lewis G. Doom, 95 Meadow Farm Road, East Islip, N.Y. 11730

[21] Appl. No.: 731,775

[22] Filed: Oct. 12, 1976

Related U.S. Application Data

[63] Continuation of Ser. No. 596,249, July 16, 1975, abandoned.

[51] Int. Cl.[2] ..... B01F 15/00

[52] U.S. Cl. ..... 366/337

[58] Field of Search ..... 259/4 AC, 4 R, 4 A, 259/4 AB, 18, 36; 138/38

[56] References Cited

U.S. PATENT DOCUMENTS

| | | | |
|---|---|---|---|
| 3,827,676 | 8/1974 | Brasie | 259/4 AB |
| 3,953,002 | 4/1976 | England | 259/4 AB |

*Primary Examiner*—Edward J. McCarthy
*Attorney, Agent, or Firm*—Francis J. Murphy

[57] ABSTRACT

A motionless mixer including a number of baffles attached to a central rod is slidably mountable within a hollow cylindrical conduit. A cross member is attached across the interior of the conduit and is configured to mate with a slot formed in the downstream end of the central rod, to prevent longitudinal motion or rotation of the mixer within the conduit.

2 Claims, 4 Drawing Figures

MOTIONLESS MIXER

This is a continuation of application Ser. No. 596,249, filed July 16, 1975, abandoned.

BACKGROUND

In the processing industries it is often necessary to mix or blend two or more fluid materials to prepare a final product. One means of providing adequate mixing of such fluids is to channel the fluids through a tubular member having a baffle assembly mounted therein, such as that disclosed in U.S. Pat. No. 3,652,061. Such an assembly may include a plurality of hemi-elliptical blades which blades are mounted in orthogonal pairs, to form baffles which deflect and mix two or more fluid streams passing through the conduit. A number of these pairs of blades are mounted at longitudinally spaced positions within the conduit with each pair of blades being rotated 90° with respect to the adjacent pairs.

As disclosed in the above U.S. Patent, individual blades of the baffle assembly may be soldered, welded or otherwise fixedly attached to the interior surface of the surrounding tube. Such a mounting arrangement has the disadvantage that the baffle blades are difficult to clean since the surrounding tubular member prevents access to them. Thorough cleaning of these blades is necessary, however, to prevent contamination of later substances which may be mixed in the mixer.

To facilitate cleaning the individual baffle blades may be mounted on a common elongated support member so that they extend radially outwardly from the member to points closely adjacent to the surrounding inner surface of the conduit. The support member and the attached baffles may then be removed from the surrounding conduit for cleaning.

Since the baffle blades are not connected to the inner surface of the tubular member the support member and blades will be free to slide longitudinally within the conduit and will also be free to rotate within the conduit due to the force of the fluid flowing past the blade surfaces. Motion of the assembly within the conduit is undesirable since it causes wear on the blades and distorts the desired mixing action. In order to prevent motion of the assembly within the conduit while providing a baffle assembly which is removable, the present invention discloses an improved mounting means which serves to hold the baffle assembly in a stable orientation within the surrounding conduit.

SUMMARY OF THE INVENTION

A motionless mixer includes a conduit defining a channel, an elongated member disposed longitudinally within the channel having a transverse end surface with a slot-like aperture formed therein and a plurality of baffle means attached to the elongated member at spaced longitudinal points. A cross member of a first cross sectional area has ends which are attached respectively to opposed sides of the channel. The cross member includes a longitudinal portion of decreased cross sectional area which is adopted to mate with the slot-like aperture in the end surface of the elongated member.

DESCRIPTION OF THE INVENTION

Figure 1:
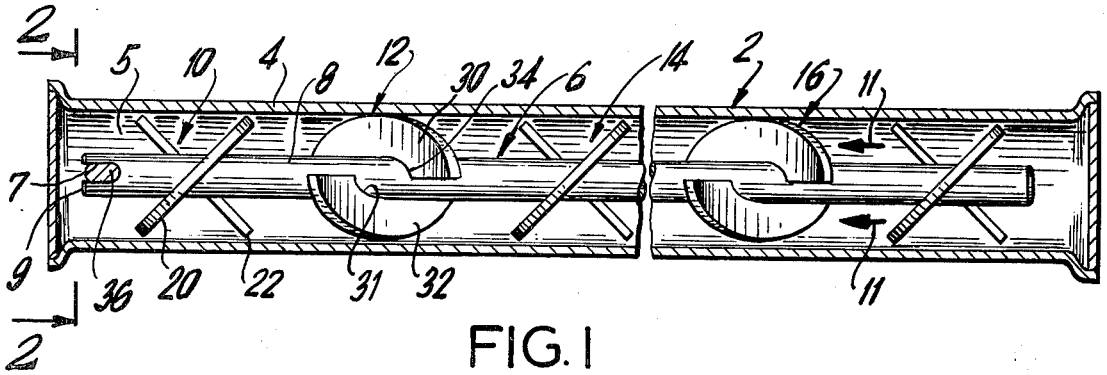
FIG. 1 is a partially cut away top view of a motionless mixer showing the improved mounting means of the present invention.

A motionless mixer 2 as shown in FIG. 1 includes a hollow conduit 4 defining a channel 5 and a baffle assembly 6 which is mounted longitudinally within the channel 5. The baffle assembly 6 includes an elongated support member 8, which may be a cylindrical rod, arranged substantially along the longitudinal axis of the conduit 4. A slot 7 is formed in a first lateral end surface 9 of the member 8.

A plurality of baffles 10, 12, 14 and 16 are attached at equally spaced longitudinal points along the member 8. Each of these baffles includes a first and a second mutually orthogonal hemi-elliptical blades. Baffle 10, for example, includes hemi-elliptical blades 20 and 22, while baffle 12 includes the hemi-elliptical blades 30 and 32. The two blades of each baffle are attached to opposed sides of member 8 and are arranged so that they are mutually orthagonal as seen for instance in blades 20 and 22 of baffle 10. Elliptical apertures such as 34 in blade 30 and 36 in blade 32 may be provided in inner side of each of the baffle blades. The blades can then be attached to member 8 along the surfaces defined by these apertures. Each baffle, such as 12, is rotated 90° with respect to adjacent baffles such as 10 and 14. In order to provide adequate mixing or blending of fluids introduced into the tubular member 4 each of the hemielliptical blades, such as 20, 22, 30 and 32 of the baffles 10 and 12 of baffle assembly 6 extend outwardly from the member 8 so that their outer edges are located immediately adjacent to the inner surface of the conduit 4.

Figure 2:
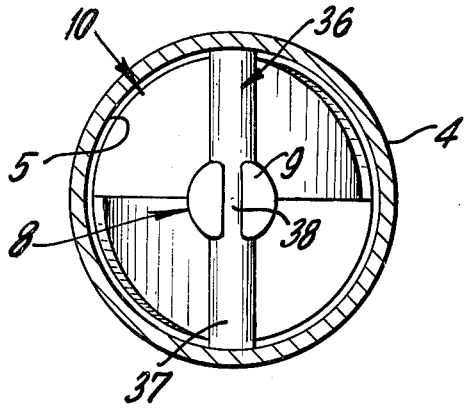
FIG. 2 is a sectional view taken along plane 2—2 of FIG. 1.

In order to hold the baffle assembly 6 in a stable orientation within the conduit 4 a cross member 36 is attached across the channel 5. This cross member 36, as best seen in FIG. 2, is fixedly attached at its ends 35 and 37 to opposed sides of the inner surface of the conduit 4. The cross member may be attached by welding, soldering or other suitable process. The cross member 36 includes a portion 38 of decreased cross sectional area which is arranged about the center of member 36 and is best seen in FIG. 2.

When the baffle assembly 6 is inserted into the conduit 4, slot 7 in the end 9 of member 8 mates with the portion 38 of cross member 36. Pressure from the fluid which flows in channel 5 in the direction indicated by arrows 11 of FIG. 1 pushes the baffle assembly 6 downstream holding the slot 7 of member 8 in firm contact with portion 38 of cross member 36 thereby maintaining the baffle assembly 6 in a substantially uniform longitudinal position within the channel 5. By the mating slot 7 with the portion 38 of cross member 36, the baffle assembly 6 is also prevented from rotation about its longitudinal axis within the channel 5. The presence of cross member 36 thereby provides both rotational and longitudinal stability for the baffle assembly 6 within the channel 5.

By utilizing a cross member 36 having a portion 38 of decreased cross sectional area, a cross member 36 may be provided having maximum width and therefore strength at its end points 35 and 37 which are connected to the inner wall of conduit 4 while having a narrower central portion to mate with the slot 7 in member 8. Since a member 8 having too great a cross sectional area would hinder fluid flow, a member of limited cross sectional area is desirable. The cross sectional area of member 8 limits the practical size of slot 7 which must be narrower than the total distance across the member. Providing a cross member 36 having an area of decreased cross sectional area 38 permits the utilization of a narrower slot 7 and thereby provides more strength for the end 9 of member 8.

Figure 3:
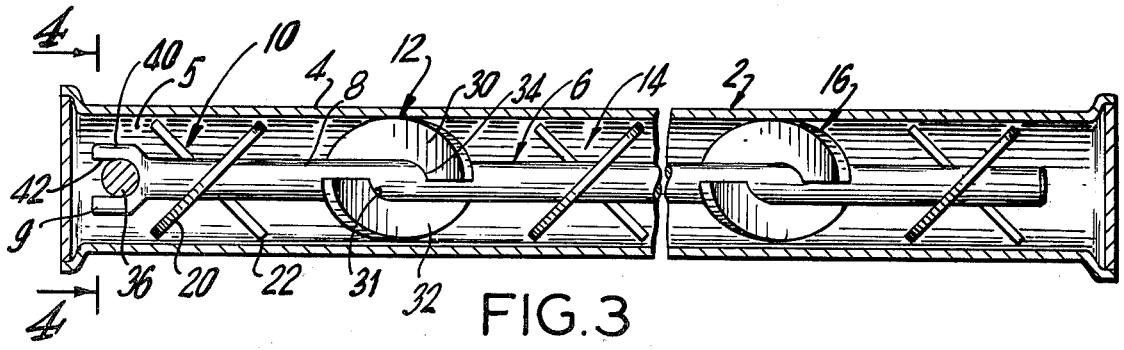
FIG. 3 is a partially cut away top view of a motionless mixer showing a second embodiment of the improved mounting means.
Figure 4:
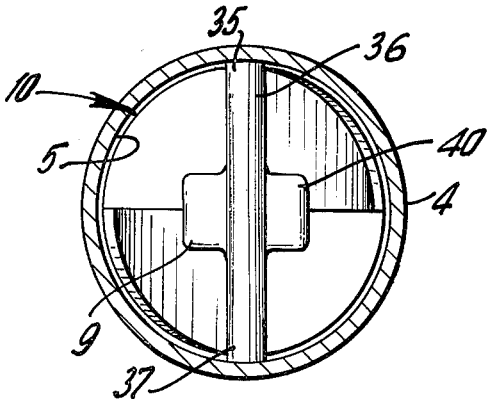
FIG. 4 is a sectional view taken along plane 4—4 of FIG. 3.

Alternatively the downstream end 9 of the supporting member 8 may include an enlarged flared portion 40 as shown in FIGS. 3 and 4. Since the portion 40 is enlarged a slot 42 can be formed in the end 9 which is slightly wider then the full distance across cross member 36. In this embodiment the whole cross sectional area of cross member 36 is available to support the baffle assembly 6. Because of the enlarged portion 40 the end 9 of member 8 is not unduly weaken by the presence of the relatively wide slot 42. Since the enlarged portion 40 is only provided adjacent to the end 9 it provides minimum resistance to fluid flowing the conduit 4. As in the embodiment described above with reference to FIGS. 1 and 2 the slot 42 provides rotational and longitudinal stability for baffle assembly 6.

I claim:

1. A motionless mixer includes a substantially cylindrical conduit defining a channel having a central axis;

an elongated member disposed longitudinally within said channel along said central axis, said elongated member having a transverse end surface and a slot-like aperture extending into and across said end surface;

a plurality of baffle means attached to said elongated member at spaced longitudinal points; and a cross member of a first cross sectional area having two ends which ends are attached respectively to two opposed sides of said channel, so that said cross member extends transversely across said channel, said cross member including at least one longitudinal portion having a smaller cross sectional area than said first cross sectional area which portion intersects said central axis and is adapted to cooperate with said slot-like aperture in said one end surface of said elongated member.

2. A motionless mixer includes a conduit defining a channel;

an elongated member disposed longitudinally within said channel, said elongated member having a first end with a transverse end surface and a slot-like aperture formed in said end surface, said elongated member further including a first portion having a substantially constant first cross sectional area and a second portion having a cross sectional area greater than said first cross sectional area said second portion extending to said first end;

a plurality of baffle means attached to said first portion of said elongated member at spaced longitudinal points; and a cross member attached across said channel in said conduit, said cross member being configured to fit within said slot in said second portion of said elongated member.

* * * * *